US008653734B2

(12) United States Patent
Matsumoto et al.

(10) Patent No.: US 8,653,734 B2
(45) Date of Patent: Feb. 18, 2014

(54) LIGHT EMITTING DEVICE

(75) Inventors: Ryuta Matsumoto, Himeji (JP); Haruo Kokado, Himeji (JP)

(73) Assignee: Phoenix Electric Co., Ltd., Himeji-Shi (JP)

( * ) Notice: Subject to any disclaimer, the term of this patent is extended or adjusted under 35 U.S.C. 154(b) by 123 days.

(21) Appl. No.: 13/290,602

(22) Filed: Nov. 7, 2011

(65) Prior Publication Data

US 2013/0026915 A1 Jan. 31, 2013

(30) Foreign Application Priority Data

Jul. 29, 2011 (JP) ..... 2011-167128

(51) Int. Cl.
*H01J 17/34* (2006.01)

(52) U.S. Cl.
USPC ..... 315/32; 362/249.02; 362/294

(58) Field of Classification Search
USPC ..... 315/32, 113, 309, 82, 76, 77, 56, 57; 313/45, 46, 318.01, 318.09; 362/184, 362/240, 351, 800, 249.07, 257, 265
See application file for complete search history.

(56) References Cited

U.S. PATENT DOCUMENTS

2010/0096992 A1* 4/2010 Yamamoto et al. ..... 315/112
2010/0327746 A1* 12/2010 Hisayasu ..... 315/51

FOREIGN PATENT DOCUMENTS

JP 2010-157506 A 7/2010
JP 2011-090843 A 5/2011

* cited by examiner

*Primary Examiner* — Alexander H Taningco
*Assistant Examiner* — Christopher Lo
(74) *Attorney, Agent, or Firm* — Lucas & Mercanti, LLP

(57) ABSTRACT

A light emitting device comprises: an LED; a LED holder having a LED mount, a radiation fin provided on a back side or a periphery of the LED mount, and an engaging part projecting from a center of the back side of the LED mount; a power circuit supplying drive power to the LED; and a body having an inner space for accommodating the power circuit, one end, and the other end where the LED holder is fixed, wherein the other end of the body has an engaged part engaged to the engaging part of the LED holder, and holding the LED mount and the radiation fin in a state of separation from the body; heat conductivity of the LED mount and the radiation fin is higher than that of the engaged part of the body.

1 Claim, 2 Drawing Sheets

LIGHT EMITTING DEVICE

BACKGROUND OF THE INVENTION

1. Field of the Invention

The present invention relates to a light emitting device with an LED designed for mainly outdoor use and used as substitute for an incandescent lamp, e.g. a mercury lamp, a halogen lamp or the like.

2. Description of Related Art

A light-emitting diode "LED", which has advantages such as low power consumption and long life as against a conventional incandescent lamp (for example, a mercury lamp or a halogen lamp), is widely used, because people become more ecology conscious. And people consider that using the LED is one policy for the energy-saving strategies. Particularly, it is highly required to use the LED as an alternate item of the incandescent lamp.

Such a request is not only for an indoor type light emitting device but for a light emitting device for outdoor use, e.g. for lighting a sign board.

A general LED emits light by several volts of DC voltage. Consequently, when a light emitting device with LED is used as substitute for an incandescent lamp, which emits light with utility 100V, 50 or 60 Hz AC voltage, a power circuit for conversion of the utility AC voltage to predetermined volts of DC voltage is required.

On the other hand, the LED emits the light and generates heat at the same time. It is also required to avoid excess high temperature of the power circuit by the heat from the LED.

Particularly, a light emitting device having a plurality of LEDs for increasing the amount of the light generates much more amount of the heat. The protection of the power circuit from the heat is an important issue.

Some protection technologies for the power circuit have been developed. For example, a light emitting device described in Patent Document 1 (Japanese Laid-Open Patent Publication No. 2011-90843) has a board of PST (polybutyleneterephthalate) plastics and heat insulator between the LED and the power circuit. The board and the insulator prevent the heat from conducting to the power circuit.

And a light emitting device described in Patent Document 2 (Japanese Laid-Open Patent Publication No. 2010-157506) has a fan inside its body. By the fan, outside air flows into inside the body through an intake slit provided on a base end of the body. The fan also exhaust the air through an exhaust slit provided on a side surface of light emitting end of the body. The air which receives the heat from the LEDs through the heat sink is exhausted forcibly, with protection of the power circuit.

BRIEF SUMMARY OF THE INVENTION

But the light emitting devices described in the Patent Document 1 and 2 as referred to above still have other issues.

In the light emitting device described in the Patent Document 1, the heat being hard to be conducted to the power circuit is radiated from a surface of a translucent glove through "a translucent member made of high heat conductivity material." This translucent member is filled up to a clearance between the LED and the glove. In other words, the surface of the glove is not only a light emitting surface but a heat radiating surface.

When an area of a radiation surface and radiation ability are required to be increased by using a fin-shape glove, a lighting angle and a lighting pattern must be changed. Consequently, to design the shape of the glove becomes too difficult and complicated.

And when the light emitting device described in Patent Document 2 is used outdoors, rain water or the like which flows into the body through the intake slit and the exhaust slit is accumulated within the body. The accumulated rain water or the like causes corrosion and electrical leakage.

The present invention is invented in view of the above-described issues of the conventional art.

Thus, a main subject of the present invention is to provide a light emitting device. The light emitting device protects a power circuit from heat of LEDs. A shape of a radiation surface of the light emitting device can be designed flexibly, because there is no relation between the shape of the radiation surface and a lighting angle and a lighting pattern. And the light emitting device can avoid corrosion and electrical leakage by avoiding accumulation of rain water or the like in outdoor use.

In accordance with an aspect of the present invention, a light emitting device 10 comprises:

an LED 12;

a LED holder 14 having a LED mount 20 where the LED 12 is mounted, a radiation fin 22 provided on a back side or a periphery of the LED mount 20, and an engaging part 24 projecting from a center of the back side of the LED mount 20;

a power circuit 18 supplying drive power to the LED 12; and a body 16 having an inner space 44*c* for accommodating the power circuit 18, one end 44*a* where a base 48 is attached, and the other end 16*b* where the LED holder 14 is fixed, wherein the other end 16*b* of the body 16 has an engaged part 40 engaged to the engaging part 24 of the LED holder 14, and holding the LED mount 20 and the radiation fin 22 in a state of separation from the body 16;

Heat conductivity of the LED mount 20 and the radiation fin 22 is higher than heat conductivity of the engaged part 40 of the body 16.

According to this aspect of the present invention, heat generated from the LED 12 in emitting the light is conducted from the LED mount 20 of the LED holder 14 to the radiation fin 22. And the heat is radiated from the radiation fin 22.

The heat conductivity of the engaged part 40 of the body 16 is lower than that of the LED mount 20 and the radiation fin 22, and the LED holder 14 is held in a state of separation from the body 16. Consequently, the heat from the LED 12 is hard to be conducted to the body 16, and the power circuit 18 accommodated in the inner space 44*c* of the body 16 is prevented from being undesirably high temperature by the heat from the LED 12.

Furthermore, the LED holder 14 and the body 16 are apart each other and are connected each other only with the engaging part 24 projected from the center of the back side of the LED mount 20 and the engaged part 40. When the light emitting device 10 is in outdoor use, the rain water or the like flows into a gap between the LED holder 14 and the body 16. But the rain water or the like does not remain in the gap; corrosion and electrical leakage or the like by the rain water can be avoided.

According to the present invention, the light emitting device protects the power circuit against the heat from the LEDs. And the shape of the radiation surface of the light emitting device can be designed flexibly, because there is no relation between the shape of the radiation surface and a lighting angle and a lighting pattern. And the light emitting device can avoid corrosion and electrical leakage by avoiding accumulation of rain water or the like in outdoor use.

DETAILED DESCRIPTION OF THE INVENTION

Hereinafter, a light emitting device of the present invention will be described based on a embodiment illustrated in drawings.

Figure 1:
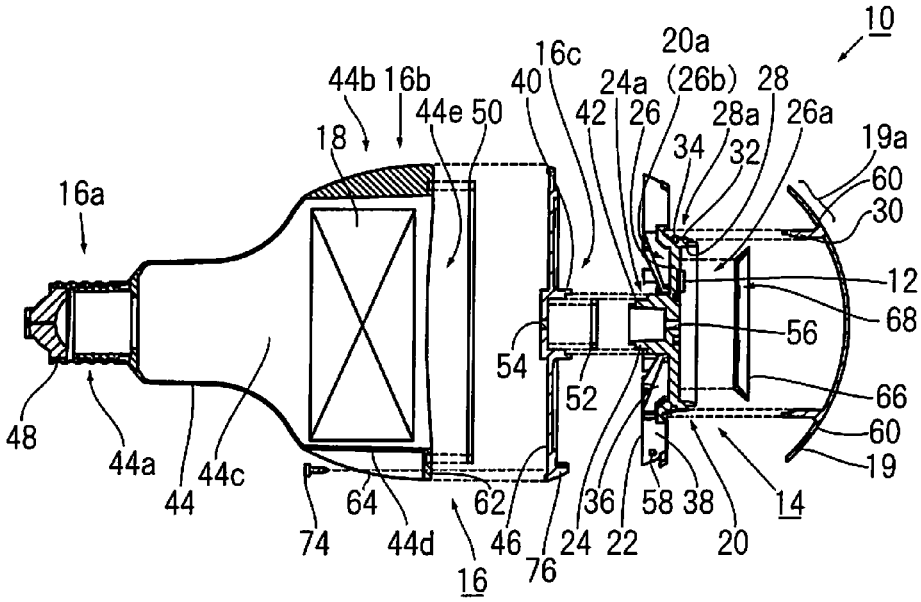
FIG. 1 is an exploded cross section showing the light emitting device of the present invention.
Figure 2:
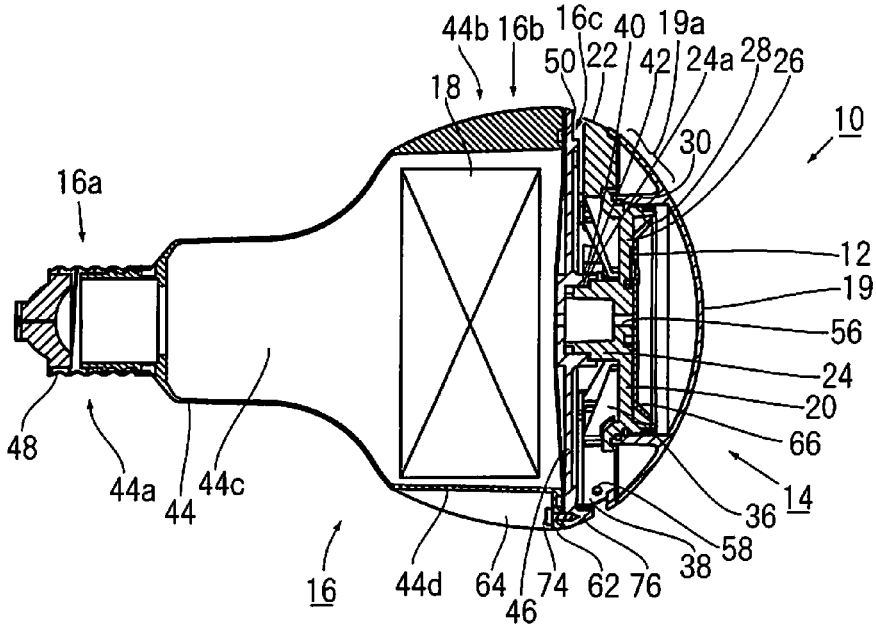
FIG. 2 is a cross section showing the light emitting device of the present invention.
Figure 3:
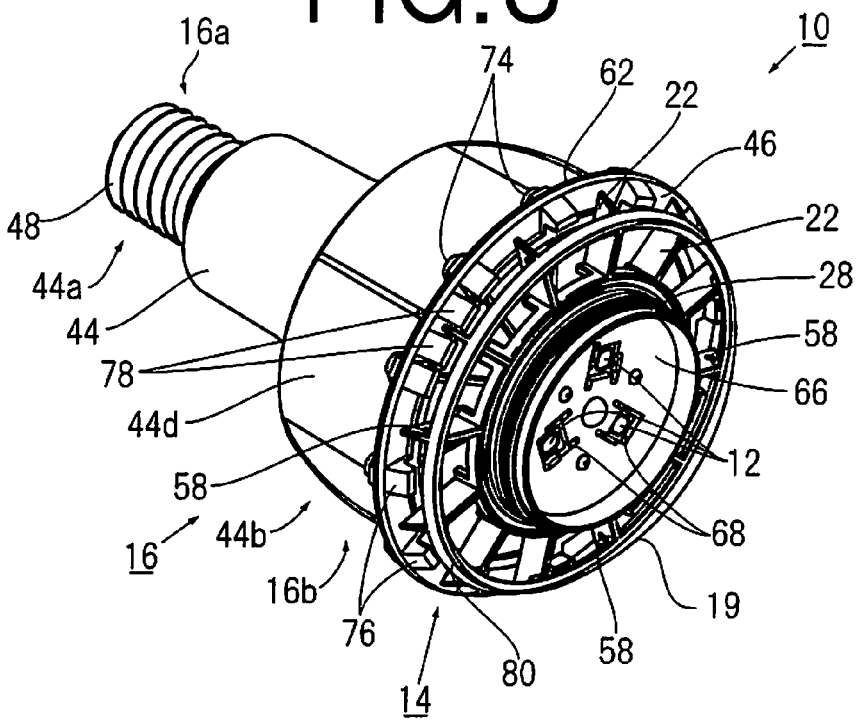
FIG. 3 is a perspective view showing the light emitting device of the present invention.

The light emitting device 10, as shown in FIG. 1 to FIG. 3, comprises: LEDs 12; an LED holder 14; a body 16; a power circuit 18; and a front cover 19 (as necessary).

The LEDs 12 are semiconductor devices which emit light by applying predetermined voltage, and the LEDs 12 are mounted on an upper surface of an LED mount 20 of the LED holder 14.

Each light emitting surface of the LEDs 14 in this embodiment is of almost a shape of an ellipse. There is no limitation on the shape. A shape of rectangle or circularity may be accepted.

Furthermore, the number of the LEDs 12 is not limited. Three LEDs 12, as shown in FIG. 3, one LED 12, two LEDs 12, or four or more LEDs 12 can be mounted on the LED holder 14.

A light distribution pattern of the LED 12 is Lambertian type. In the light distribution pattern of the Lambertian type, almost of all light flux is concentrated on the light axis and near the light axis. Fifty percent of all light flux from the LED 12 forms −30 to +30 degrees with the light axis; seventy percent of all light flux forms −45 to +45 degrees; ninety percent of all light flux forms −60 to +60 degrees.

The LED holder 14 is integrally composed by the LED mount 20, a radiation fin 22, and an engaging part 24.

The LED mount 20 is a member where the LEDs 12 are mounted as described above. In this embodiment, as shown in FIG. 1, the LED mount 20 has a disk-shaped LED mounting board 26 where the LEDs 12 are mounted and a cylindrical part 28 extended from the periphery of the LED mounting board 26. And the LED mount 20 is formed with high heat conductivity materials, for example aluminum or ceramic.

The LEDs 12 is mounted and a printed power circuit (not shown) for supplying electric power to the LEDs 12 are formed on the light emitting surface 26*a* of the LED mounting board 26. And an external thread 32 covered and screwed together an engaging cylinder part 30 of a front cover 19 is formed on an outer surface 28*a* of the cylindrical part 28.

Furthermore, a pressing board 66 for pressing the printed power circuit is screwed on the light emitting surface 26*a* of the LED mounting board 26.

And for preventing the rain water or the like from entering into the light emitting surface 26*a* of the LED mounting board 26, an o-ring 34 for the cylindrical part 28 is provided between the cylindrical part 28 and the engaging cylinder part 30.

A thin packing or gasket may be wound around the outer surface 28*a* of the cylindrical part 28 as substitute for the o-ring.

Figure 4:
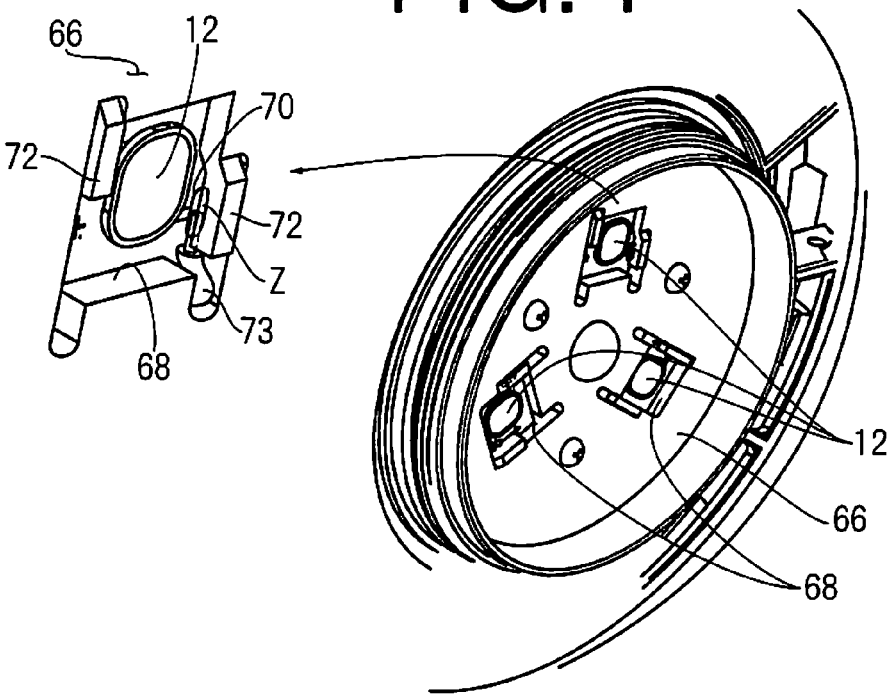
FIG. 4 is a partially enlarged view of FIG. 3.

The pressing board 66 has openings 68. The openings 68 are located on places corresponding to each LED 12 as shown in FIG. 4; each LED 12 fits into the opening 68 respectively. The light from each LED 12 is emitted through the opening 68.

A pair of elastic pressing parts 72 is projected from opposed two sides of each opening 68.

Each LED 12 has a pair of terminals 70, a positive and a negative. Feeder cables 73, which electrically connect the terminals 70 to the power circuit, are soldered to the terminals 70.

The elastic pressing parts 72 are formed at the positions where a solder connecting parts Z are. The solder connecting parts Z are thick parts where the feeder cables 73 are soldered. When the pressing board 66 is screwed onto the light emitting surface 26*a* of the LED mounting board 26, the elastic pressing parts 72 elastically press the solder connecting parts Z toward the light emitting surface 26*a*.

The elastic pressing parts 72 of this pressing board 66 press the solder connecting parts Z of the terminals 70 of the LEDs 12 and the feeder cables 73 toward the light emitting surface 26*a*. In case that the heat from the LEDs 12 is conducted to the solder connecting parts Z, where the feeder cables 73 are fixed to the terminals 70, continuously or intermittently over the long term, creep, crack, or peeling of solder at the solder connecting part Z can be generated. The elastic pressing parts 72 prevents the feeder cables or the solder connecting parts Z from separating from the terminals. Consequently, extinction of the LEDs 12 can be avoided.

The radiation fin 22 is a plurality of thin plates which are projected from the periphery and the back side 20*a* of the LED mount 20. The back side 20*a* means the opposite surface of the light emitting surface 26*a*. And the radiation fin 22 is formed with high heat conductivity materials like the LED mount 20.

In this embodiment, each radiation fin 22 has a near trapezoidal shape fin base 36 and near rectangular outer fin 38. The fin base 36 is provided on the back side 26*b* of the LED mounting board 26 toward the opposite direction of the light emitting direction. The outer fin 38 projects outward from the peripheral side of the fin base 36 and the periphery of the LED mount 20.

In this embodiment, as shown in FIG. 3, a radiation fin fixing ring 80 is provided. The radiation fin fixing ring 80 is continuously attached to each peripheral upper end of the outer fins 38. Consequently, the radiation fin fixing ring 80 prevents the outer fins 38 from being bent undesirably.

And it is preferred to form a hole 58 for running through an anti-drop wire against dropping the light emitting device 10 from a device holder. In this embodiment, the hole 58 is formed at outer end of the radiation fin 22 (see FIG. 1).

It is preferred to place this light emitting device 10 at high-place.

The engaging part 24 is a cylinder projected from the center of the back side 26*b* of the LED mounting board 26. And the engaging part 24 is formed with high heat conductivity materials like the LED mount 20.

An engaging external thread 42 is formed on the outer surface 24*a* of the engaging part 24. The engaged part 40 covers the engaging external thread 42. The engaging external thread 42 is screwed together with the engaged part 40 projected from the other end surface 16*c* of the body 16.

And a first through hole 56 for running through feeder cables for power circuit (not shown) is formed at the center of the LED mounting board 26, more properly at the center of the engaging part 24. One ends of the feeder cables for power circuit are connected to the power circuit 18, and the other ends of the feeder cables for power circuit are connected to the printed power circuit on the light emitting surface 26*a* of the LED mounting board 26.

In addition, the LED mount 20, the radiation fin 22, and the engaging part 24 may be formed integrally or may be formed individually and individual material. At least, the LED mount 20 and the radiation fin 22 must be formed with materials having heat conductivity higher than that of the engaged part 40 of the body 16.

The body 16 has a main body 44 and a cover 46.

The main body 44 has a bottomed cylindrical body. One end 44*a* of the main body 44, i.e. one end 16*a* of the body 16, has small diameter; the other end 44*b* of the main body 44, i.e. the other end 16*b* of the body, has large diameter. And the main body 44 is formed with low heat conductivity material, for example PBT [polybutyleneterephthalate] plastic.

A base 48 of the light emitting device 10 is attached to one end 44*a* of the main body 44. And the power circuit 18 and necessary feeder cables for power circuit (not shown) are accommodated in the inner space 44*c* of the main body 44.

A flange 62 is extended outward from complete periphery of the other end surface of the main body 44 in this embodiment. And side fins 64 supporting the flange 62 is formed on the side surface 44*d* of the main body 44.

The cover 46 is a disk-shaped member formed with the same material as the main body 44, for example PBT plastic. The diameter of the cover 46 is determined so as to cover an opening formed at the other end surface of the main body 44 and to coincide with the flange 62 of the main body 44.

The inner space 44*c* of the main body 44 can be watertight by fixing the cover 46 to the other end surface of the main body 44.

In this embodiment, an o-ring 50 is provided on the other end surface, where contacts the cover 46, of the main body 44. And the flange 62 and periphery of the cover 46 can be screwed by the screws 74 from the back side of the flange 62 of the main body 44. Consequently, the inner space 44*c* can be further watertight.

Screw receiving parts 76 projecting from the cover 46 toward the light emitting direction are provided at positions corresponding to the screws 74. The receiving parts 76 avoid exposure of the screws 74; the appearance of the light emitting device 10 can be improved.

The means for fixing the cover 46 to the main body 44 not limited to screw. Other means, for example adhesion or the like, may be used.

Furthermore, as shown in FIG. 3, a pair of stoppers 78 projecting from periphery of the cover 46 toward the same direction of the screw receiving parts 76 may be provided side by side. The periphery of one radiation fin 22 is placed between one stopper 78 and the other stopper 78. Consequently, the LED holder 14 (and the front cover 19) is prevented from turning undesirably against the body 16 by external force, vibration, or the like.

An engaged part 40 projecting toward the LED holder 14 is provided on the center of the cover 46. The engaged part 40 supports the LED mount 20 and the radiation fin 22 in a state of separation from the body 16 by engaging the engaging part 24 of the LED holder 14.

A second through hole 54 for running through feeder cables for power circuit (not shown) is provided at the center of the cover 46 (more precisely, the center of the engaged part 40.) One ends of the feeder cables for power circuit are connected to the power circuit 18, and the other ends are connected to the LEDs 12.

The engaging part 24 and the engaged part 40 may be joined each other by screw, adhesion, or the like.

It is preferred to provide an o-ring 52 to the interface between the engaging part 24 and the engaged part 40 for further watertight.

It is not necessary to separate the body 16 with the main body 44 and the cover 46. The engaged part 40 may be provided integrally on the other end 16*b* of the body 16.

The power circuit 18 comprising capacitors, diodes, or the like is accommodated in the inner space 44*c* of the main body 44 of the body 16. The power circuit 18 converts electrical power, usually commercial AC power, supplied from an outside source through the base 48 to the power for the LEDs 12, usually several DC voltage. The power circuit 18 supplies the converted power to the LEDs 12.

The front cover 19 is suitable for the outside use of the light emitting device 10. The front cover 19 is transparent or translucent member having the smooth convex curvature toward the light emitting direction. At least the front cover 19 covers the light emitting surface 26*a* of the LED mounting board 26 of the LED holder 14 in a watertight condition.

In this embodiment, the diameter of the front cover 19 is determined so as to cover not only the LED mounting board 26 but also near periphery of the radiation fin 22.

An engaging cylinder part 30 screwing in and covering the cylindrical part 28 of the LED mount 20 is projected from the center of the back side, i.e. a concaved surface opposes to the light emitting direction.

The rain water or the like entering into the back side, which faces the radiation fin 22, of the periphery 19*a* of the front cover 19 through the LED holder 14 and the other end surface 16*c* of the body 16 can accumulates. The periphery 19*a* of the front cover 19 means all part except a part providing watertight cover for the light emitting surface 26*a* of the LED mounting board 26. It is preferred to provide a drain hole 60 on the periphery 19*a* for outdoor use.

Furthermore, a plurality of drain holes 60 may be provided, because an angle of the light emitting device 10 in outdoor use depends on users.

A procedure in the making of the light emitting device 10 is explained as follows. The power circuit 18 and necessary feeder cables for power circuit are accommodated to the inner space 44*c* of the main body 44 being fixed the base 48. The other end of the feeder cable for power circuit of which one end is connected to the power circuit 18 is passed through the second through hole 54 and the first through hole 56 and is guided to the light emitting surface 26*a* of the LED mount 20. Then, the other end of the feeder cables for power circuit is connected to the printed power circuit (not shown) provided on the light emitting surface 26*a* of the LED mounting board 26.

The LEDs 12 are mounted on the light emitting surface 26*a* of the LED mount 20; the feeder cable 73 connects the terminal 70 of the LEDs 12 and the power circuit. Then the power circuit pressing board 66 is screwed.

Finally, the front cover 19 is fixed to the light emitting side surface of the LED holder 14. The light emitting device 10 is completed.

According to the light emitting device 10 in this embodiment, the heat from the LEDs 12 in emitting light is radiated and conducted to the radiation fins 22 through the LED mount 20 of the LED holder 14.

The heat conductivity of the engaged part 40 of the body 16 is lower than that of the LED mount 20 and the radiation fin 22, and the LED holder 14 is held in a state of separation from the body 16. Consequently, the heat from the LED 12 is hard to be conducted to the body 16, and the power circuit 18 accommodated in the inner space 44*c* of the body 16 is prevented from being undesirably high temperature by the heat from the LED 12.

Furthermore, the LED holder 14 and the body 16 are apart each other and are connected each other only with the engaging part 24 projected from the center of the back side of the LED mount 20 and the engaged part 40. When the light emitting device 10 is in outdoor use, the rain water or the like flows into a gap between the LED holder 14 and the body 16. But the rain water or the like does not remain in the gap; corrosion and electrical leakage or the like by the rain water can be avoided.

Although the invention has been described in its preferred form with a certain degree of particularity, it is understood that the present disclosure of the preferred form has been changed in the details of construction and the combination and arrangement of parts may be resorted to without departing from the spirit and scope of the invention as hereinafter claimed.

The disclosure of Japanese Patent Application No. 2011-167128 filed Jul. 29, 2011 including specification, drawings and claims is incorporated herein by reference in its entirety.

What is claimed is:

1. A light emitting device comprising:

an LED;

a LED holder having a LED mount where the LED is mounted, a radiation fin provided on a back side or a periphery of the LED mount, and an engaging part projecting from a center of the back side of the LED mount;

a power circuit supplying drive power to the LED; and a body having an inner space for accommodating the power circuit, one end where a base is attached, and the other end where the LED holder is fixed, wherein the other end of the body has an engaged part engaged to the engaging part of the LED holder, and holding the LED mount and the radiation fin in a state of separation from the body;

a first through hole aligned with a second through hole for running through feeder cables for power circuit, is formed at the center of the engaging part and the center of the engaged part, and one ends of the feeder cables for the power circuit are connected to the power circuit, and the other ends of the feeder cables for power circuit are connected to the LED, an o-ring is provided in the interface between the engaging part of the LED holder and the engaged part of the body;

heat conductivity of the LED mount and the radiation fin is higher than heat conductivity of the engaged part of the body.

* * * * *